US008839494B1

(12) United States Patent
Screens

(10) Patent No.: US 8,839,494 B1
(45) Date of Patent: Sep. 23, 2014

(54) MOTORCYCLE BOOT STRAP

(76) Inventor: Michael D. Screens, Romeoville, IL (US)

( * ) Notice: Subject to any disclaimer, the term of this patent is extended or adjusted under 35 U.S.C. 154(b) by 380 days.

(21) Appl. No.: 13/052,847

(22) Filed: Mar. 21, 2011

(51) Int. Cl.
*A41F 17/04* (2006.01)

(52) U.S. Cl.
USPC ..... 24/72.1; 24/300; 24/301; 24/302

(58) Field of Classification Search
CPC ..... A41F 17/04
USPC ..... 24/298, 299, 300, 301, 302, 72.1
See application file for complete search history.

(56) References Cited

U.S. PATENT DOCUMENTS

| | | | | | |
|---|---|---|---|---|---|
| 211,479 | A | * | 1/1879 | Shelby | 2/335 |
| 397,968 | A | * | 2/1889 | Carter | 24/72.1 |
| 610,967 | A | * | 9/1898 | Hill | 24/337 |
| 1,392,816 | A | * | 10/1921 | Crocker | 24/517 |
| 1,782,057 | A | * | 11/1930 | Bollinger | 24/301 |
| 3,000,067 | A | * | 9/1961 | Hanflig | 24/298 |
| 3,058,183 | A | * | 10/1962 | Hawie | 24/328 |
| 3,727,272 | A | * | 4/1973 | Rhodes | 24/300 |
| 4,115,906 | A | * | 9/1978 | Lavine et al. | 24/72.1 |
| 4,345,345 | A | * | 8/1982 | Holtz | 5/640 |
| 5,377,391 | A | * | 1/1995 | Foster | 24/72.5 |
| 5,489,075 | A | * | 2/1996 | Ible | 248/104 |
| 5,542,156 | A | | 8/1996 | Oglesby | |
| 5,655,270 | A | * | 8/1997 | Boisvert | 24/336 |
| 5,675,841 | A | * | 10/1997 | Jackson | 2/175.7 |
| 5,852,849 | A | * | 12/1998 | Lansing et al. | 24/3.4 |
| D463,325 | S | * | 9/2002 | Savoia | D11/200 |
| 6,520,495 | B1 | * | 2/2003 | La Mendola | 269/45 |
| D488,288 | S | * | 4/2004 | Eggers | D2/624 |
| 7,174,607 | B1 | * | 2/2007 | Buettell | 24/504 |
| D611,678 | S | * | 3/2010 | Bailey | D2/624 |
| 2007/0192998 | A1 | | 8/2007 | Ryder | |
| 2009/0031537 | A1 | * | 2/2009 | Muscarella et al. | 24/72.1 |

* cited by examiner

*Primary Examiner* — Robert J Sandy
*Assistant Examiner* — David Upchurch
(74) *Attorney, Agent, or Firm* — Ice Miller LLP

(57) ABSTRACT

The present invention is a pant leg cuff retaining device for maintaining a pant leg cuff relative to a user's footwear, having a strap with clips assemblies removable attached to each end for providing a means of removing the strap while not removing the attachment devices.

15 Claims, 4 Drawing Sheets

MOTORCYCLE BOOT STRAP

RELATED APPLICATION DATA

None.

FIELD OF THE INVENTION

The present invention relates generally to a pant leg cuff retaining device for maintaining a pant leg cuff in a position relative to a user's footwear. The device of the present invention includes a strap with clips assemblies removably attached to each end.

BACKGROUND OF THE INVENTION

A common inconvenience to motorcycle riders and riders of other similar vehicles is the upward travel of pant legs as the vehicle is in motion. To solve this problem, riders often wear devices to retain the pant leg cuffs in their desired position. Often, in addition to the functionality of the device, riders desire a decorative element on the device. To that end, it is known in the art to have various devices to retain a pant leg cuff that include a decorative element on a part of the device that can be seen by others. However, if a rider desires a different decorative element (or to have no decorative element at all), he or she must purchase an entire new device. This can be costly and inconvenient. It is therefore desirable to have a pant leg retaining device that has interchangeable or removable decorative elements, allowing one to purchase various different decorative elements, rather than purchase numerous entire devices.

In addition, once a rider is no longer on the vehicle it is usually necessary to remove the device; however, often the device requires manipulation of the attachment means and can be difficult to remove or disengage from the user's pant cuffs. This can be especially inconvenient when the wearer is only dismounting from his or her vehicle for a short period of time and anticipates putting the device on again shortly. In such a situation, it is desirable to have a device that can be easily removed and reattached in substantially the same position. Specifically, it is desirable to have a strap that can be removed from a clip portion of the device that is secured to the pant cuff.

The use of devices to secure pant cuffs in a desired position is generally known in the art. For example, U.S. Pat. No. 4,115,906 for Lavine et al. discloses an apparatus for maintaining the cuff of a pant leg in a downward position having an elastic strap and locking clips at each end of the strap adapted to clip to a wearer's pant cuff. However, Lavine does not disclose a means for quickly removing the strap without removing the attachment devices from the wearer's pant leg.

U.S. Pat. No. 5,542,156 to Oglesby discloses a trouser leg retaining device that keeps trouser legs attached to shoes to keep a pant leg from moving upward. The device includes chain links on either side of an elastomeric strap that are attached to a fastening means at each end. The device in Oglesby is intended to be used in conjunction with snaps positioned on the interior of the user's pants legs. While Oglesby provides a way to remove the strap without removing the entire means of attachment, Oglesby does not provide a means by which the position of the attachment to the pant leg may be altered or removed entirely. In addition, the device in Oglesby requires the user to wear pants specifically adapted for use with the disclosed device.

Patent application Ser. No. 11/668,953 by Ryder also discloses an attachment device for retaining pant legs in proper position while traveling on a vehicle such as a motorcycle. The device by Ryder includes a front attachment assembly having one or more clips and a rear or back attachment assembly having one or more clips, at least one of which attaches to a user's pant leg. However, the device by Ryder requires a user to wear a modified boot adapted to receive the attachment device.

Accordingly, there remains a need for a device which retains a user's pant leg cuff in a position relative to the user's footwear that does not required a modified pant or boot and that provides a means to easily remove the strap, while not requiring the full removal of the device from the user's pant leg cuff. Similarly there remains a need for a device with interchangeable attachment pieces so as to allow a user to change the decorative clip element of the device.

SUMMARY OF THE INVENTION

The embodiments of the present invention described herein address the shortcomings of the prior art. In general terms the invention may be described as including the following:

A pant cuff retaining device for maintaining the position of a pant cuff relative to a user's footwear, the device comprising a flexible strap having two ends, each of the ends being provided with an attachment assembly comprising: (a) a clip comprising first and second mating portions; (b) the first mating portion attached to said flexible strap and adapted to releasably connect to the second mating portion; (c) the second mating portion having a clamp adapted to be releasably attached to an edge of a pant cuff.

In another embodiment of the present invention, the flexible strap comprises a polymer material. The polymer may be rubber or any elastic polymer which allows the strap to stretch along a longitudinal axis. In another embodiment of the present invention, the clip is comprised of a polymer material. Alternatively, the clip is comprised of metal or may include both metal and polymer elements. Further, in one embodiment of the present invention, the clip comprises a snap buckle.

The present invention also includes an embodiment in which the clip resists movement between the first and second mating portions along a longitudinal axis. In a further embodiment, the first and second mating portions releasably connect along a longitudinal axis. In another embodiment, the clamp provides pressure along an axis perpendicular to said longitudinal axis.

The present invention may also generally be described as including the following:

A pant cuff retaining device for maintaining the position of a pant cuff relative to a user's footwear, said device comprising a flexible strap having two ends, each of the ends being provided with an attachment assembly comprising: (a) a clip comprising first and second mating portions; (b) the first mating portion attached to the flexible strap and adapted to releasably connect to the second mating portion; (c) the second mating portion having a clamp adapted to be releasably attached to an edge of a pant cuff (d) wherein the clamp comprises: (1) a jaw element having an upper jaw member and lower jaw member pivotally affixed to one another; (2) the jaw element having a bracket; (3) a clamp element having a clamping portion and a lever portion, the clamp element pivotally mounted to said bracket; (4) wherein the pivoting of the lever portion toward the upper jaw element causes the clamping portion to engage the upper jaw member so as to push the upper jaw member toward the lower jaw member. In one embodiment of the present invention, each of the upper and lower jaw portions has at least one tooth for engaging a pant leg cuff.

Further, in an embodiment of the present invention, the pivoting of the clamp element toward the jaw element causes the clamping element to engage the upper jaw member, pushing it toward the lower jaw member, thereby causing the jaws to clamp together.

Preferably, the jaws have at least one tooth for engaging the pant leg cuff between them. In one embodiment, the strap may be made of an elastic material, allowing the user to stretch the strap from one side of the boot to the opposite side for a snug fit. The strap may be of various lengths to accommodate different size footwear. In yet another embodiment the clip assemblies are removably attached from the flexible strap by a snap buckle means. The device of the present invention may also include decorative elements attached to the clip assemblies.

DETAILED DESCRIPTION OF THE PREFERRED EMBODIMENTS

In accordance with the foregoing summary, the following describes a preferred embodiment of the present invention which is considered to be the best mode thereof. With reference to the drawings, the invention will now be described in detail with regard for the best mode and preferred embodiment.

Figure 1:
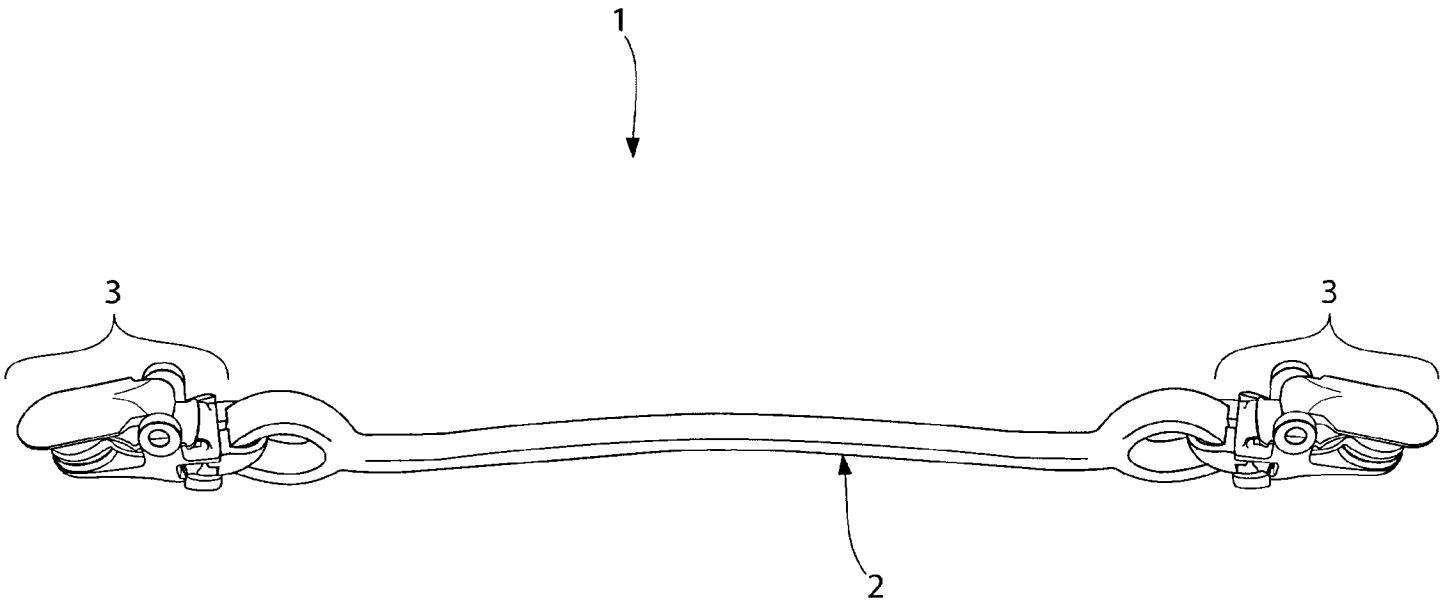
FIG. 1 is an upper-side perspective view of the device in accordance with one embodiment of the present invention.

FIG. 1 illustrates an upper-side perspective view of the device 1 having a flexible strap 2 and first and second attachment assemblies 3. The flexible strap 2 may be comprised of any flexible material such as a fabric, polymer or leather. Preferably, flexible strap 2 is comprised of a rubber or elastic polymer material that allows the flexible strap to stretch along its longitudinal axis as it is wrapped around the bottom of a user's footwear. The strap may be of various lengths to accommodate different size footwear. In the preferred embodiment, the strap may be six inches long for use with men's footwear or four inches long for use with women's footwear. In the preferred embodiment, four inch strap may be stretched to seven inches to accommodate different size women's footwear. Similarly, in the preferred embodiment, the six inch strap may be stretched to eleven inches to accommodate different size men's footwear. Preferably, a user may attached one of the attachment assemblies to an outside portion of his or her pant cuff, stretch the flexible strap portion of the device under and around the bottom of his or her footwear, and attach the second attachment assembly to an inside portion of his or her pant cuff.

Figure 2:
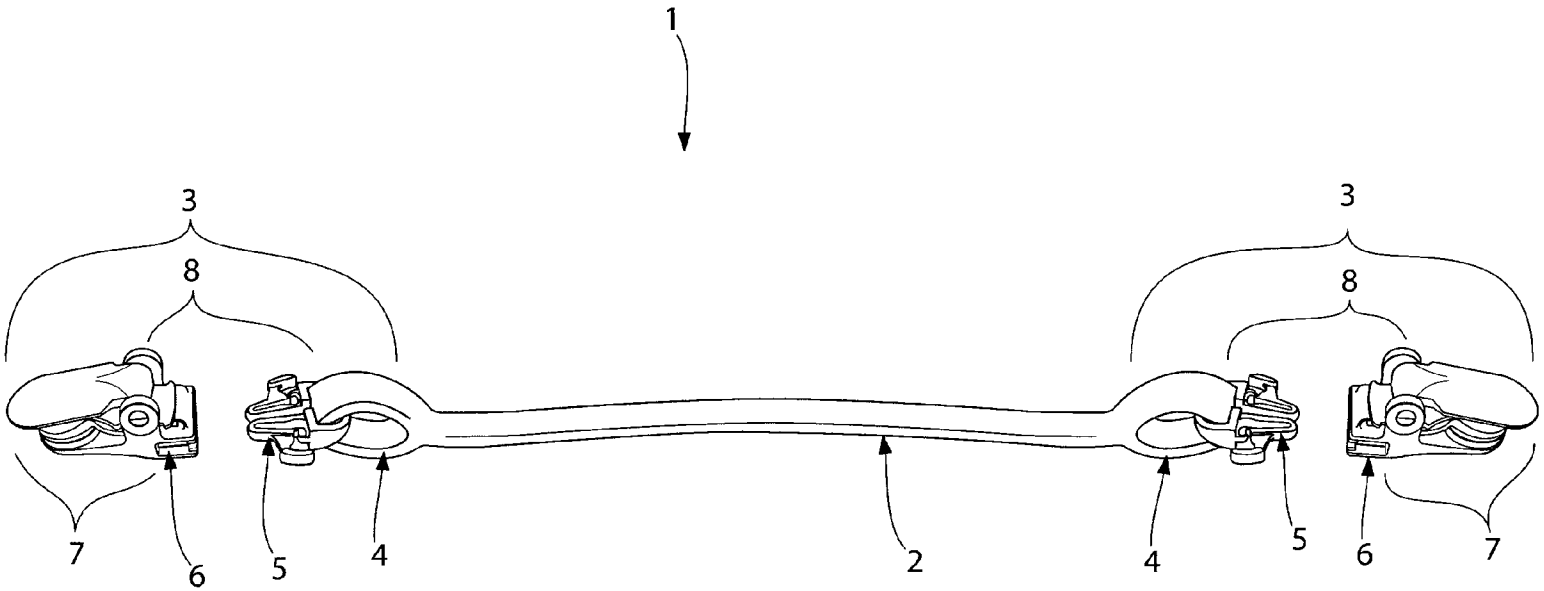
FIG. 2 is an upper-side perspective view of the device in accordance with one embodiment of the present invention.

FIG. 2 is an upper-side perspective view of the device 1 and illustrates flexible strap 2 and first and second attachment assemblies 3. FIG. 2 further shows clip assemblies 8 having first mating portions 5 and second mating portions 6. FIG. 2 also illustrates flexible strap 2 having first and second loops 4 at each end of flexible strap 2 attached to first mating portions 5 at each end of flexible strap 2. FIG. 2 also shows each second mating portions 6 having a clamp 7.

The present invention is not limited to any specific clip design and various conventional clip designs can be used and are considered within the scope and spirit of the invention. The clip assemblies may be comprised of any durable material such as plastic or metal. In the preferred embodiment, the clips are comprised of substantially of nylon with a metal element disposed on the clamp, as further described herein.

Figure 3B:
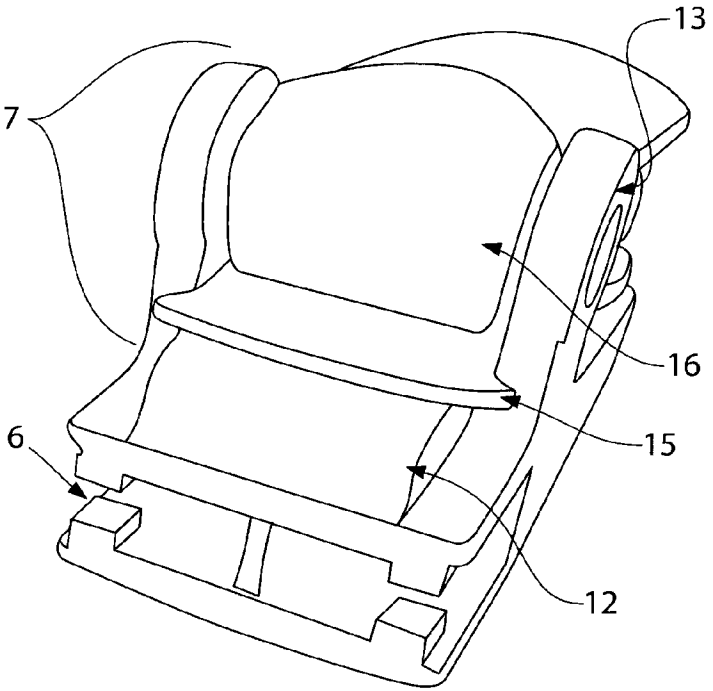
FIG. 3B is a back plan view of a second mating portion of the device in accordance with one embodiment of the present invention.
Figure 3A:
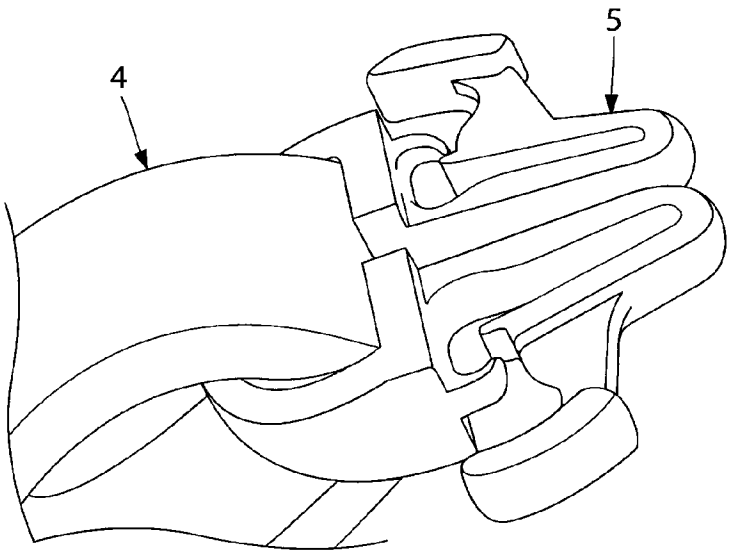
FIG. 3A is an upper-side perspective view of a first mating portion of the device in accordance with one embodiment of the present invention.

FIG. 3A is an upper-side perspective view of a first mating portion of the device in accordance with one embodiment of the present invention. FIG. 3A shows loop 4 of one end of flexible strap 2 (not shown) attached to first mating portion 5. In the preferred embodiment of the present invention, first mating portion 5 is a male attachment portion adapted to insert along a longitudinal axis into second mating portion 6, which, in the preferred embodiment, is a female attachment portion. Further, in the preferred embodiment, the male and female attachment portions releasable connect and resist movement along a longitudinal axis.

In the preferred embodiment, the male and female attachment portions comprise a snap buckle; however, the present invention may be practiced using any means of attachment, including, but not limited to, a clasp, hook, snap hook, bolt snap, D-ring, clip lock and other similar means of attachment.

FIG. 3B is a back perspective view of a second mating portion of the device in accordance with one embodiment of the present invention. FIG. 3B shows second mating portion 6. In the preferred embodiment of the present invention, second mating portion 6 is a female attachment portion. FIG. 3B further shows clamp 7 of second mating portion 6. In FIG. 3B, clamp 7 has bracket 13, pivot point 12 of upper jaw member 10 and lower jaw member 11 (show in FIG. 4A), metal engagement member 15 and clamping portion 16. Further, in FIG. 3B, clamp 7 is shown in the clamped position. In the preferred embodiment, clamping portion 16 engages metal engagement member 15 when lever portion 14 is rotated toward jaw element 9 (both elements shown in FIG. 4A).

Figure 4A:
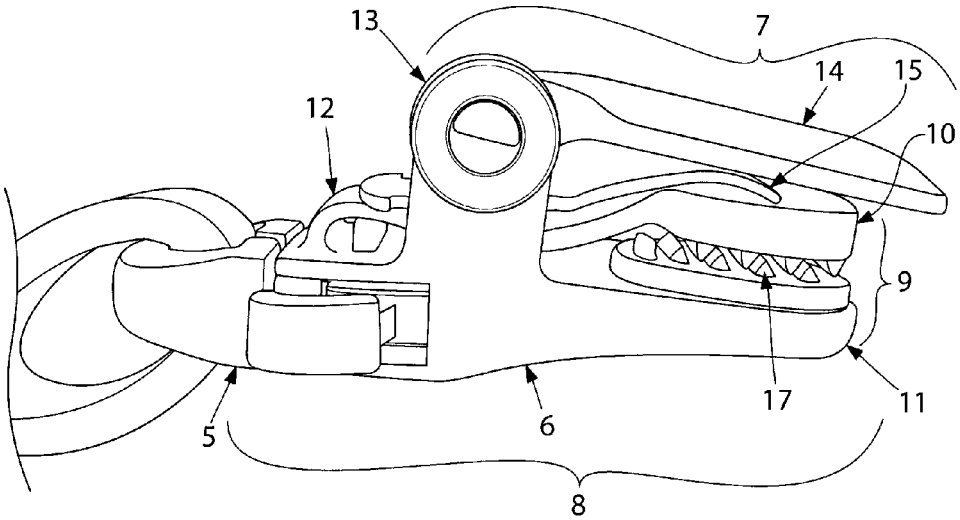
FIG. 4A is a side plan view of an attachment assembly in a clamped position in accordance with one embodiment of the present invention.

FIG. 4A is a side plan view of an attachment assembly in a clamped position in accordance with one embodiment of the present invention. FIG. 4A shows clip 8 having first and second mating portions 5 and 6. FIG. 4A further shows clamp 7 having jaw element 9 having upper jaw member 10 and lower jaw member 11 pivotally attached at point 12. FIG. 4A further shows clamp 7 having bracket 13, lever portion 14 and metal engagement member 15. FIG. 4A also illustrates lever portion 14 pivotally attached to bracket 13 and teeth 17 of upper and lower jaw members 10 and 11.

In the preferred embodiment of the present invention, when clamp 7 is in the clamped position, lever portion 14 is disposed adjacent to metal engagement member 15 and clamping portion 16 (shown in FIG. 3B) exerts a downward force on metal engagement member 15, thereby forcing upper jaw member 10 toward lower jaw member 11.

Figure 4B:
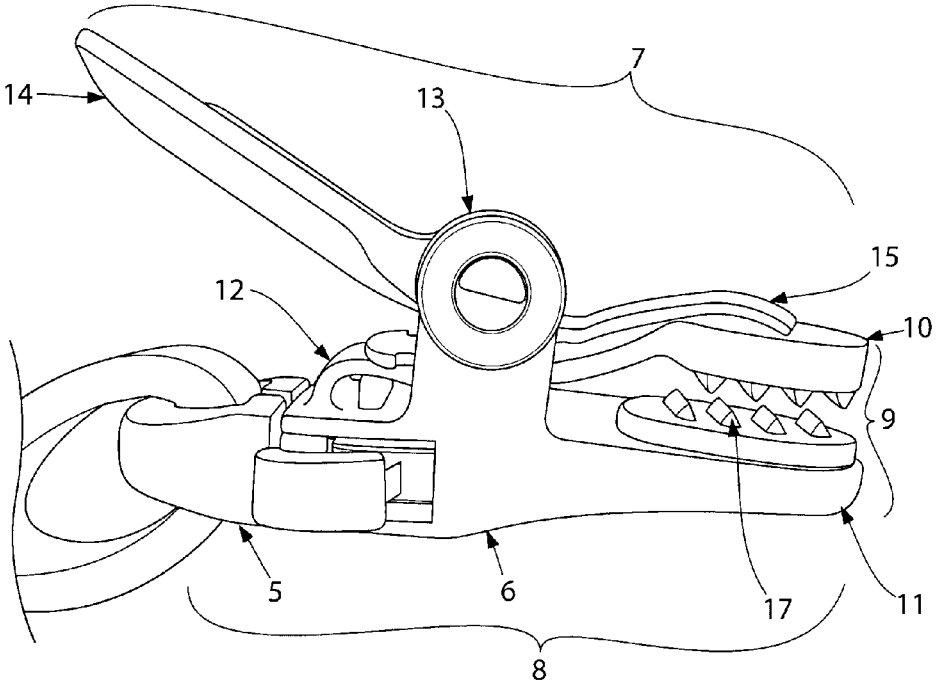
FIG. 4B is a side plan view of an attachment assembly in an unclamped position in accordance with one embodiment of the present invention.

FIG. 4B is a side plan view of an attachment assembly in an unclamped position in accordance with one embodiment of the present invention. FIG. 4B shows clip 8 having first and second mating portions 5 and 6. FIG. 4B further shows clamp 7 having jaw element 9 having upper jaw member 10 and lower jaw member 11 pivotally attached at point 12. FIG. 4B further shows clamp 7 having bracket 13, lever portion 14 and metal engagement member 15. FIG. 4A also illustrates lever portion 14 pivotally attached to bracket 13 and teeth 17 of upper and lower jaw members 10 and 11.

In the preferred embodiment of the present invention, when clamp 7 is in the unclamped position, lever portion 14 is in an open position and rotated away from jaw element 9. Clamping portion 16 is similarly rotated away from metal engagement member 15, thereby exerting little or no downward force on metal engagement member 15 and upper jaw member 10, allowing upper jaw member 10 to move away from lower jaw member 11.

In one embodiment of the present invention, lever portion 14 further comprises a decorative element that substantially covers the surface of lever portion 14.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A pant cuff retaining device for maintaining the position of a pant cuff relative to a user's footwear, said device comprising a flexible strap having a longitudinal axis and two ends, each of said ends being provided with an attachment assembly comprising:

a clip assembly comprising separable first and second mating portions, wherein said first mating portion comprises a male attachment portion and said second mating portion comprises a female attachment portion, wherein the male attachment portion is configured to releasably connect along the longitudinal axis to the second mating portion in a mated configuration and resist movement along the longitudinal axis;

wherein said first mating portion is attached to said flexible strap; and said second mating portion is releasably connected to said first mating portion at a first side of said second mating portion along said longitudinal axis, and said second mating portion comprises a clamp configured to releasably attach to an edge of a pant cuff, wherein said clamp is configured to be releasably connected to said pant cuff at a second side of said second mating portion along said longitudinal axis and opposite said first side of said second mating portion.

2. The device of claim 1, wherein said flexible strap comprises a polymer material.

3. The device of claim 1, wherein said clip is comprised of a polymer material.

4. The device of claim 1, wherein said clip is comprised of metal.

5. The device of claim 1, wherein said clip comprises a snap buckle.

6. The device of claim 1, wherein said clip resists movement between said first and second mating portions along a longitudinal axis.

7. The device of claim 1, wherein said clamp provides pressure along an axis perpendicular to said longitudinal axis.

8. A pant cuff retaining device for maintaining the position of a pant cuff relative to a user's footwear, said device comprising a flexible strap having a longitudinal axis and two ends, each of said ends being provided with an attachment assembly comprising:

a clip assembly comprising separable first and second mating portions, wherein said first mating portion comprises a male attachment portion and said second mating portion comprises a female attachment portion, wherein the male attachment portion is configured to releasably connect along the longitudinal axis to the second mating portion in a mated configuration and resist movement along the longitudinal axis;

wherein said first mating portion is attached to said flexible strap; and said second mating portion is releasably connected to said first mating portion at a first side of said second mating portion along said longitudinal axis, and said second mating portion comprises a clamp configured to releasably attach to an edge of a pant cuff, wherein said clamp is configured to be releasably connected to said pant cuff at a second side of said second mating portion along said longitudinal axis and opposite said first side of said second mating portion;

wherein said clamp comprises:

a jaw element having an upper jaw member and lower jaw member pivotally affixed to one another;

said jaw element having a bracket;

a clamp element having a clamping portion and a lever portion, said clamp element pivotally mounted to said bracket;

wherein the pivoting of said lever portion toward said upper jaw element causes said clamping portion to engage said upper jaw member so as to push said upper jaw member toward said lower jaw member.

9. The device of claim 8, wherein each of said upper and lower jaw portion has at least one tooth for engaging said pant leg cuff.

10. The device of claim 8, wherein said flexible strap comprises a polymer material.

11. The device of claim 8, wherein said clip is comprised of a polymer material.

12. The device of claim 8, wherein said clip is comprised of metal.

13. The device of claim 8, wherein said clip comprises a snap buckle.

14. The device of claim 8, wherein said clip resists movement between said first and second mating portions along the longitudinal axis.

15. The device of claim 8, wherein said clamp provides pressure along an axis perpendicular to said longitudinal axis.

* * * * *